United States Patent [19]

Szwarcbier

[11] 4,205,650

[45] Jun. 3, 1980

[54] START AID FOR COMBUSTION ENGINE

[76] Inventor: Szymon Szwarcbier, 3355 Queen Mary Rd., No. 730, Montreal, Quebec, Canada, H3V 1A5

[21] Appl. No.: 913,227

[22] Filed: Jun. 6, 1978

[30] Foreign Application Priority Data

May 15, 1978 [CA] Canada ..... 303300

[51] Int. Cl.[2] ..... F02N 17/00

[52] U.S. Cl. ..... 123/146.5 A; 123/146.5 R; 123/179 H

[58] Field of Search ..... 123/146.5 A, 148 S, 123/146.5 R, 148 R, 148 A, 179 B, 179 BG

[56] References Cited

U.S. PATENT DOCUMENTS

| | | | |
|---|---|---|---|
| 2,660,656 | 11/1953 | Wilkie | 123/146.5 R |
| 2,798,109 | 7/1957 | Voight | 123/146.5 R |
| 3,087,980 | 4/1963 | Monnig | 123/146.5 R |
| 3,680,539 | 8/1972 | Savage et al. | 123/148 S |
| 4,088,109 | 5/1978 | Woodruff et al. | 123/179 B |
| 4,106,465 | 8/1978 | Bernhardt et al. | 123/159 BG |
| 4,107,510 | 8/1978 | Tombs et al. | 123/145 A |

FOREIGN PATENT DOCUMENTS

| | | | |
|---|---|---|---|
| 220121 | 4/1921 | Canada | 123/146.5 A |
| 249692 | 10/1921 | Canada | 123/146.5 A |
| 258137 | 8/1922 | Canada | 123/146.5 A |
| 248236 | 3/1925 | Canada | 123/146.5 A |
| 325208 | 3/1932 | Canada | 123/146.5 A |
| 541366 | 5/1957 | Canada | 123/146.5 A |

*Primary Examiner*—Charles J. Myhre
*Assistant Examiner*—R. A. Nelli
*Attorney, Agent, or Firm*—Swabey, Mitchell, Houle, Marcoux & Sher

[57] ABSTRACT

The disclosure describes an improvement to facilitate the start of an internal combustion engine, more particularly during wet weather and at low temperatures. The improvement comprises heating means associated with the spark plugs and/or with the engine distributor, a switch or a timer and lead connecting the heating means through the switch or timer, to the vehicle battery.

7 Claims, 9 Drawing Figures

START AID FOR COMBUSTION ENGINE

The invention relates to an improvement to facilitate the start of an internal combustion engine, more particularly during wet weather and at low temperatures.

The purpose of the invention is to act upon the most sensitive locations involved in the starting process of an internal combustion engine.

It is therefore an object of this invention to keep the distributor contacts dry, to accelerate the vapourization of the fuel which is drawn into the engine, and to improve the ignition produced by the spark plugs.

According to the invention, there are provided heating means associated with the spark plugs and/or with the engine distributor, a switch or a timer, and leads connecting the said heating means through said switch or "timer", to the vehicle battery.

During wet weather, and particularly at low temperatures, vehicles with internal combustion engines are known to be difficult, and often impossible, to start. One of the reasons for this is that the fuel siphoned into the cylinders is only partly vapourized, so that the spark plug electrodes and the distributor contacts become wet. The spark produced during the start-up is unable fully to overcome the damp spark plug electrode and to ignite the mixture which does not contain enough vapourized fuel. Repeated attempts to start the engine finally run down the battery.

Several devices for improving the starting of combustion engines are already known.

These devices consist essentially of heater elements which warm up the engine block. Since heating the block requires a large amount of energy, which the battery is unable to supply without loosing all of its energy, the necessary energy for the heater elements is taken from a source other than the battery. The disadvantage of these devices is, therefore, that they can be used only where power from a main is available, and a motorist stranded en route is thus helpless.

According to the invention, a device which uses power from the battery in cold and damp weather, to act upon the most important elements of the ignition system is proposed in order to provide rapid and reliable motor start-up.

This energy, instead of being wasted initially in uselessly operating the starter, is used to keep the distributor contacts dry, to keep the spark plug electrodes dry, and to supply heat which will cause the fuel siphoned into the cylinders to vapourize more rapidly.

In the drawings which illustrate embodiments of the invention:

Figure 1:
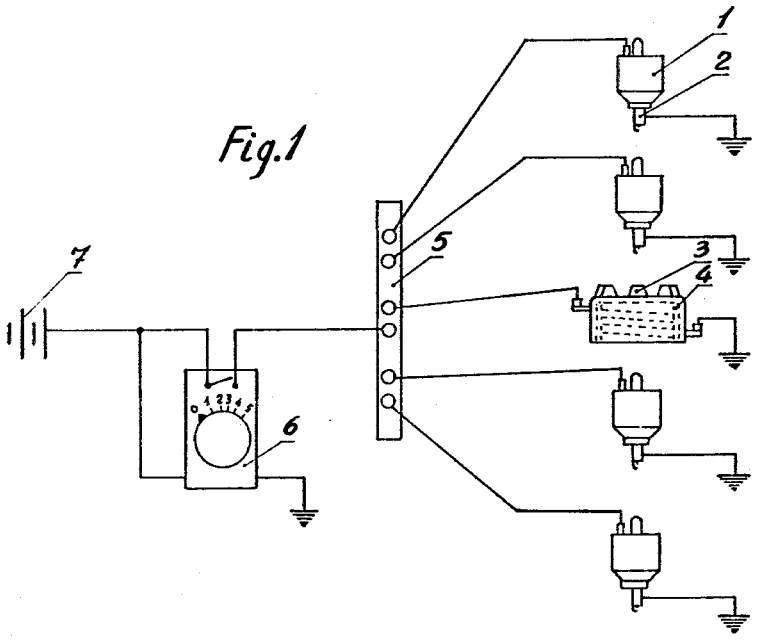
FIG. 1 is a diagrammatic representation of the improvement according to the invention.

FIG. 1 shows heater elements 1 placed over the spark plugs 2 of an internal combustion engine (not shown), and a distributor 3 with a built-in heater element 4. All of the heater elements are connected to the vehicle battery 7 through the terminal strip 5 and timer 6.

Figure 2:
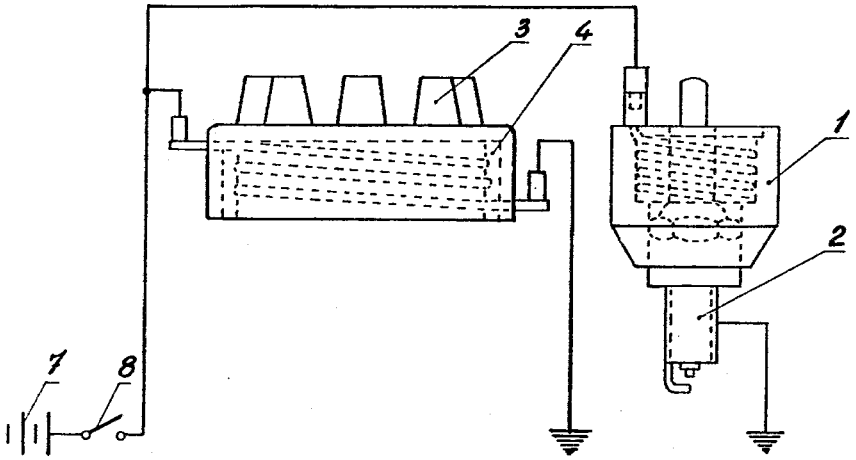
FIG. 2 shows, on an enlarged scale, the connection of a spark plug heater element and a distributor heater element to the vehicle battery.

FIG. 2 shows, on an enlarged scale, the connection of spark plug heater element 1 to the spark plug 2 and distributor heater element 4 and the distributor 3 through the switch 8, to the battery 7.

Figure 3:
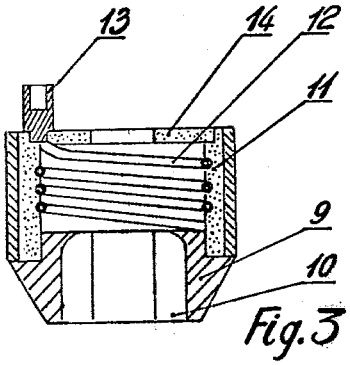
FIG. 3 is a longitudinal section through the spark plug heater element.

FIG. 3 is a longitudinal section through the heater element, the housing 9 thereof being made of metal and having a hexagonal opening 10 matching a hexagonally shaped spark plug. Heating coil 12 is arranged on a cylinder 11 made of an incombustible, insulating substance, preferably a ceramic, the bottom of which is secured to the said housing, while the top is provided with a contact 13. The heater element is covered by a ceramic disc 14.

Figure 4:
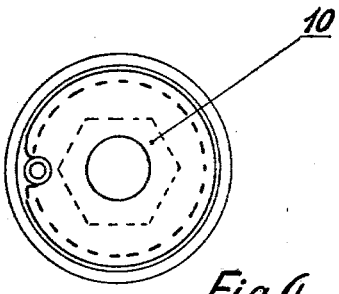
FIG. 4 is a plan view of the device illustrated in FIG. 3.

FIG. 4 is a plan view of the heater element showing the hexagonal opening 10.

Figure 5:
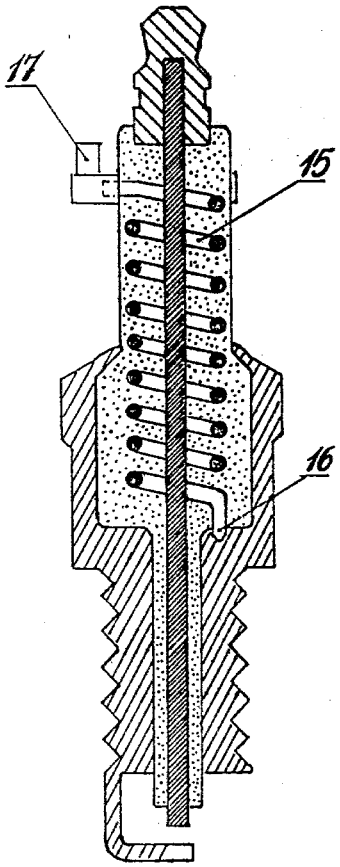
FIG. 5 shows a spark plug with a heating coil embedded in the ceramic part thereof.

FIG. 5 shows a spark plug with a heating coil 15 embedded in the insulator thereof. The lower end of the heating coil 16 is connected to the spark plug body, while the upper end of the coil, which projects out of the spark plug insulator, is provided with a contact 17.

As a result of the arrangement of heating coil 15 and contact 17, the spark plug assumes a dual function, since it is now not only a spark plug but also a heater element, and its purpose is firstly to keep the spark plug electrode dry before the engine is started and, secondly, to supply heat, through the part of the plug which projects into the cylinder, in order to promote rapid vapourization of the still cold fuel.

Surprising results are obtained at a minimal cost and the arrangement is extremely compact.

Figure 6:
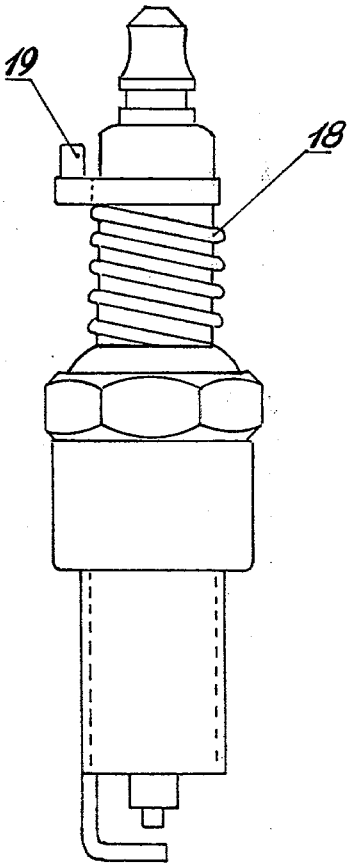
FIG. 6 shows a spark plug with a heating coil wound around the ceramic portion thereof.

FIG. 6 shows a spark plug with a heating coil 18 wound around the ceramic spark plug insulator, the lower end of the said heating coil being secured to the spark plug body, while the upper end is provided with a contact 19.

Here again the plug has a dual function.

The advantage of this arrangement is that commercially available spark plugs may be fitted, at a small cost, with heater elements consisting merely of a coil and a contact.

Figure 7:
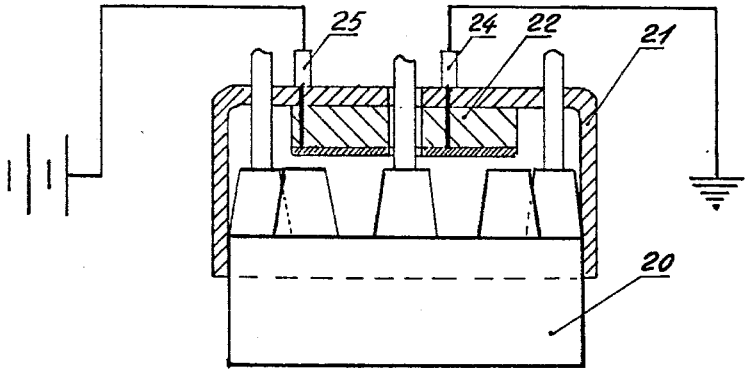
FIG. 7 is a longitudinal section of a heater element placed upon a distributor.
Figure 8:
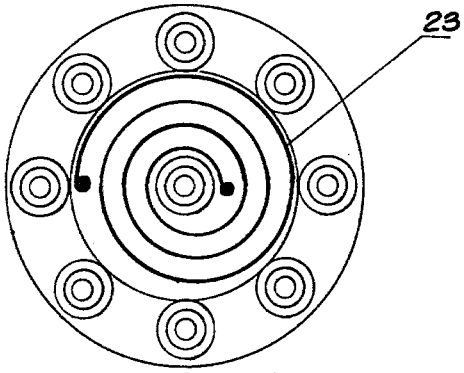
FIG. 8 is a plan view of the device illustrated in FIG. 7.

FIGS. 7 and 8 show a heater element placed upon a distributor 20. Located in the housing 21 is a ceramic part 22 serving as a carrier for heating coil 23 (FIG. 8), the ends of which are provided with contacts 24, 25 connected respectively to the engine block and the vehicle battery.

Figure 9:
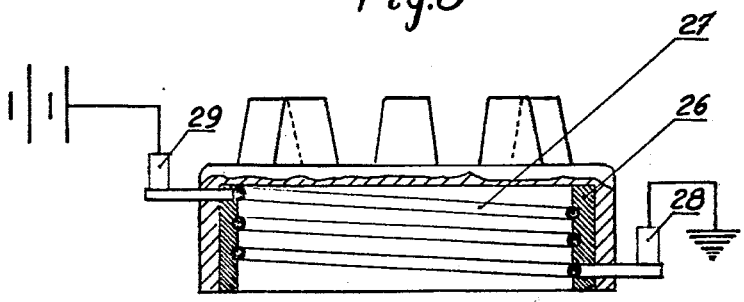
FIG. 9 shows a heater element incorporated internally into the upper part of the distributor.

FIG. 9 shows a distributor having a heater element in the form of a cylindrical ceramic carrier 26, a heating coil 27, and contacts 28, 29.

The advantage of this arrangement is that the heat from the heater element can act directly upon the distributor contacts. A supply of heat to the interior of the distributor is useful for starting the engine, since this is very often where water condenses and wets the contacts.

The starting of the engine, using the device according to the invention, is carried out as follows.

The switch, or timer, is switched on. As soon as the heater elements have supplied sufficient heat for starting to sensitive locations, the power supply to the said elements is cut off. The engine is then started in known fashion. It is much better to use the current to warm up the heater elements than to turn the engine over unsuccessfully.

The proposed starting aid provides numerous advantages. Engine wear is reduced and battery life is increased. The labour and expense associated with the reactivation of the vehicle with a dead battery are saved.

I claim:

1. A system for facilitating the starting of an internal combustion engine, including spark plugs, a distributor and a battery connected in a circuit, comprising:

(a) heating means for said spark plugs, (b) heating means for said distributor, (c) switching means in the circuit between the battery and said spark plug heating means, (d) said spark plug heating means comprises:

(1) a metal housing,

(2) a cylinder of non-combustible insulating material in said housing,

(3) a heating coil having upper and lower parts on the wall of said cylinder,

(4) the lower part of said heating coil being connected to said metal housing,

(5) a contact embedded in said cylinder, and

(6) the upper part of said heating coil being connected to said contact.

2. A system as defined in claim 1 wherein the bottom of said housing has a hexagonal opening therein for conforming to the shape of a hexagonal spark plug.

3. A system as defined in claim 1 wherein the top of said heating element includes a disc cover of insulating, non-combustible material thereon.

4. A system as defined in claim 1 wherein said material is ceramic.

5. A system as defined in claim 1 wherein said switching means includes a timer for controlling the length of time current is supplied to said spark plug heating means and said distributor heating means.

6. A system for facilitating the starting of an internal combustion engine, including spark plugs, a distributor and a battery connected in a circuit, comprising:

(a) heating means for said spark plugs, (b) heating means for said distributor, (c) switching means in the circuit between the battery and said spark plug heating means, (d) said spark plug including:

(1) a middle electrode,

(2) an insulator surrounding said middle electrode,

(3) said heating means being integrally embedded in said insulator and surrounding said middle electrode for causing said spark plug to be used selectively as a spark plug and as a heater element, thereby enabling said spark plug to have a double function.

7. A system as defined in claim 6 wherein said switching means includes a timer for controlling the length of time current is supplied to said spark plug heating means and said distributor heating means.

* * * * *